US006106406A

United States Patent [19]

Jouan

[11] Patent Number: 6,106,406

[45] Date of Patent: Aug. 22, 2000

[54] GOLF PRACTICE DEVICE

[76] Inventor: Dominique Jouan, 17 rue Braille, Brest, France, 29200

[21] Appl. No.: 08/981,343

[22] PCT Filed: Jun. 20, 1996

[86] PCT No.: PCT/FR96/00966

§ 371 Date: Apr. 15, 1998

§ 102(e) Date: Apr. 15, 1998

[87] PCT Pub. No.: WO97/00711

PCT Pub. Date: Jan. 9, 1997

[30] Foreign Application Priority Data

Jun. 20, 1995 [FR] France ..... 95 07615

[51] Int. Cl.[7] ..... A63B 69/36

[52] U.S. Cl. ..... 473/146; 473/149

[58] Field of Search ..... 473/223, 224, 473/228, 233, 234, 236, 237, 146, 149, 280

[56] References Cited

U.S. PATENT DOCUMENTS

| | | | |
|---|---|---|---|
| 976,176 | 11/1910 | Hollingsworth | 473/236 |
| 2,214,356 | 9/1940 | Wettlaufer | 473/233 |
| 3,622,161 | 11/1971 | Keppen . | |
| 3,741,550 | 6/1973 | Landures . | |
| 4,223,891 | 9/1980 | Van Gaasbeek et al. . | |
| 5,451,059 | 9/1995 | Weis | 473/146 |

FOREIGN PATENT DOCUMENTS

| | | |
|---|---|---|
| 2 614 544 | 11/1988 | France . |
| 383767 | 12/1931 | United Kingdom . |

*Primary Examiner*—George J. Marlo
*Attorney, Agent, or Firm*—Merchant & Gould P.C.

[57] ABSTRACT

This invention relates to a device for the teaching of golf characterized in that it includes a pedestal (1), a head (2) mounted on said pedestal (1), said head (2) having a face (3) that is essentially reversed with respect to the face of the head of a golf club, and means for indicating the strike angle (4) of said club on said head (2) that includes a disc (8) integral with said head (2) and rotatably mounted on said pedestal (1) essentially in the plane of the pedestal, said head being positioned approximately at the center of said disc, and means for the display (12) of the displacement of said disc (8) in relation to said pedestal (1) following the impact of said club on said retractable head (2). The head (2) can be fixed or movably mounted on the pedestal in such a way that it retracts under the impact transmitted by the golf club in order not to hinder the trajectory of it.

13 Claims, 5 Drawing Sheets

GOLF PRACTICE DEVICE

The invention relates to the field of sport and more precisely to the field of golf.

Golf is a sport whose highly technical nature often constitutes a difficult obstacle for its players to overcome. For this reason, golf players must generally turn to a course of learning in order to develop their game.

The swing is the technical basis of golf and may be broken down into four phases: a placement and aiming phase (the address), a preparation phase (the back-lift), a motive phase (the descent), a slowing down phase (the finish). The technique of the swing is therefore given great importance in the context of the teaching of golf, it being possible to work on each of the phases that make it up.

So as to permit golfers to improve their swing, within the state of the technology, there are pieces of equipment designed to allow them to work on the movements that form the basis of the swing.

Within the state of the technology, there are also items of equipment that allow the movements of the club to be displayed. Such equipment uses various techniques (photography, video, analysers, lasers, computers . . . ).

Nevertheless, it becomes apparent from the teaching of golf that many players despite great effort of will, do not achieve the essential physical requirement of feeling the area of impact of the club on the ball. From this follows poor control of the trajectory of the club, the angle formed by the club against the ball and, consequently the trajectory followed by the ball subsequent to the impact communicated by the club.

The main objective of this invention is to provide a pedagogic tool for the teaching of golf that allows the golfer to better understand the movement of his club at the level of the area of impact with the ball.

Another objective of the invention is to provide such a tool which can be matched to any type of club. According to the circumstances of the game, golfers use clubs which are differentiated from one another by the angle of inclination of the face or the loft, calculated from the axis of the shaft, this angle going from zero degrees for the putter up to about 700 for the most open club.

Yet another objective of the invention is to provide such a tool that is able to be used to allow a player to perfect the trajectory given to the club and also the height of the strike of this club in relation to a ball.

Yet another objective of the invention is to provide such a device of mechanical design that does not require the operation of any electric or electronic component.

These different objectives are achieved thanks to the invention which relates to a device for the teaching of golf characterised in that it includes an essentially flat pedestal, a head mounted on said pedestal having a face that is essentially reversed with respect to the face of the head of a golf club, and means for indicating the strike angle of said club on said head that includes a disc integral with said head and rotatably mounted on said pedestal essentially in the plane of the pedestal, said head being positioned approximately at the centre of said disc, and means for the display of the displacement of said disc in relation to said pedestal following the impact of said club on said retractable head.

It should be noted that the trajectory followed by the ball following the impact of the club on it depends essentially on three parameters, namely:

- the path followed by the club which determines the initial path of the ball;
- the angle formed by the face of the club with the ball which determines the final observed effect on the ball,

- the height of the path of the club and/or the angle of the face of the club with respect to the ball (the strike height).

According to the information supplied by the disc of the device, the player can then correct his swing and possible his address in a way that improves the quality of impact and, as a consequence, the trajectory followed by the ball. Such a disc is integrated into the pedestal of the device in such a way that it does jut out from it.

The pedestal of the device according to the invention has a thickness provided for it that does not allow it to protrude over too much ground so that it does not hinder the player and allows him to take up a position identical to the position he would take on a golf course. Advantageously, this pedestal can be covered with a material that imitates grass. It should be noted that this pedestal preferably does not have any projecting element, apart from the retractable head, so that the swing can proceed normally.

In one embodiment of the invention, the head of the device is movably mounted on said pedestal and is able to retract itself under the impact transmitted by a golf club in such a way that the trajectory of the club is not hindered. However, this head may also be produced in a material having a certain elasticity and be fixed by its base to the pedestal. In accordance with such a characteristic, the head can temporarily retract at the time of the impact of the club and return into position automatically after passage of the club.

During the swing, such a head is retracted by the club as soon as the club touches it. According to the strike angle, the means of indicating the strike angle of the device are operated in a way that reflects the nature of that angle.

Hence the device constitutes an apparatus that allows the player to work on the nature of the impact that he gives to the ball using the club. The invention thus allows one to tackle a pedagogic aspect of the teaching of golf that is of particular interest since it comes close to the real conditions of practice of this game.

The rotation of the disc will be facilitated by the presence of bearings. However so as to prevent excessive rotation of the disc, it will also be possible to provide means that allow this rotation to be attenuated. Such an aim would notably be achieved by not using ball bearings whilst limiting the surface area of the pedestal in contact with the lower part of the disc. Such an aim could also be achieved by providing surface irregularities or a slope on a part of the pedestal in contact with the disc. It could also be considered that the rotation of the disc be limited by creating friction between the folded back head and the pedestal.

During the operation of the means that permit the strike angle to be evaluated, the impact of the club on the golf causes movement of the disc immediately the strike angle is not equal to 0, that is to say when the strike is not technically correct. This movement of the disc can be easily displayed using said display means provided for this purpose. On this subject, one should note that the means of display of the movement of the disc may be constituted in numerous ways. However, preferably, these display means include a graduated scale provided on said disc and/or on said pedestal. Such a graduated scale allows a more accurate indication to be given of the strike angle and hence the extent of the fault in the strike. Preferably, this graduated scale is coloured. This graduated scale can thus, for example, be made up of an arrow or any other indicating mark provided on the disc (or on the pedestal) and areas of different colours distributed around the disc on the pedestal (or around the pedestal on the disc).

Advantageously, the retractable head is made up of an element integral with the disc that includes two arms for fixing it onto the disc, said arms extending essentially over the whole diameter of said disc. In this way, the forces transmitted by the face of the club to the reversed face of the retractable head are communicated to the periphery of the disc from the moment that they are not perpendicular to this reversed face and are sufficiently developed to be translated into a significant movement of the disc. In effect it is important that the disc turns sufficiently to indicate the fault to the user of the device and the extent of the fault. It should be noted that the means that allow rotation of the disc on the pedestal will have to be chosen in a way that does not check the movement of the disc but also as made clear above, does not amplify the movement too much in such a way that both a qualitative and quantitative assessment of the fault in the strike is possible.

Equally advantageously, said head is detachable and interchangeable. Hence it is possible to match the device to all the golf clubs, from the putter to the club having the greatest angle of loft.

According to an advantageous variant, said device includes means of adjusting the inclination of said head which equally allows it to be matched to all the golf clubs, by permitting more or less inclination of its reversed face. In practice, these means of adjustment will be designed in such a way that allows the reversed face of the head to be positioned from being vertical (corresponding to a club of the putter type) to being at an angle of about 70° (corresponding to the most open clubs). They can, for example, be made up of a toothed pin, placed in front of the head in a voided space specially provided for this purpose which is able to co-operate with notches provided on another component in a way that enables it to adopt several positions.

As has already been made clear above, the nature of the impact transmitted by the club to the ball depends on the strike angle and equally on the height of the strike of the ball.

So as to allow the player also to work on this parameter, the device according to the invention will also include means of indicating the height of the strike of said club on said retractable head. It should be noted that within the context of this description, the term "means of indicating the height of the strike" is understood to mean means that allow a more or less precise indication to be given of the height of the impact of the club on the head.

In one embodiment of the invention, these means of indicating the height of the strike will be constituted by the material covering the pedestal. In this case, this material will have surface irregularities that will produce a noise when they are touched by the club during the swing. Such a material could, for example be synthetic turf.

In another embodiment, these means could be constituted by an element movable mounted in the retractable head which is capable of retracting only when the height of the strike of said club on said retractable head is correct. Such an element is described in Patent Application FR 9507615. At the time of the swing, this element will only be knocked down when the impact of the club on the head occurs at a sufficiently low pedestal height. The height of this second element will therefore be chosen in a way that corresponds to a correct height of strike according to golfing practice.

Thanks to such means, the player can work not only on the angle of strike made by the club but also on the height of the strike, which is particularly important for beginners who frequently have a tendency to hit the ground during the swing.

The invention and the various advantages it offers will be more easily understood from the description that will follow of a non-limitative embodiment, that refers to the drawings in which.

Figure 1:
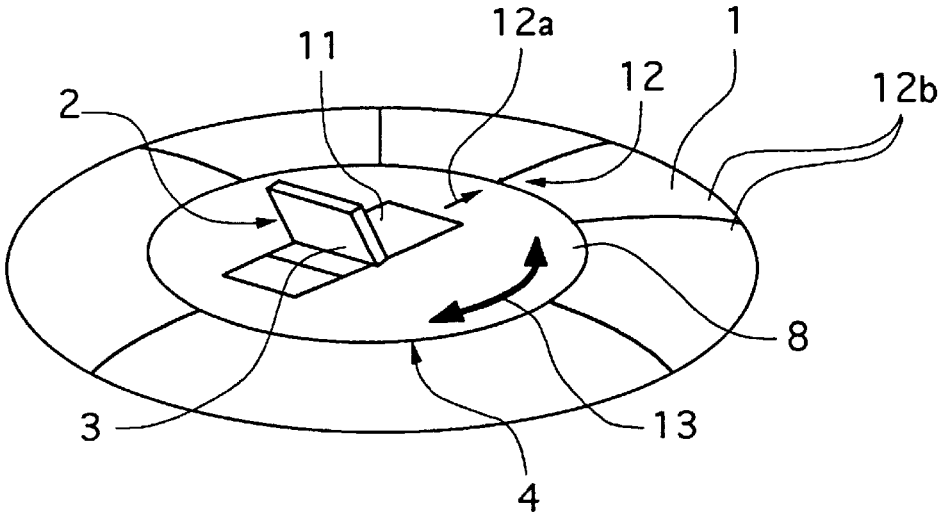
FIG. 1 represents a general perspective view of said embodiment.

Referring to FIG. 1, the device for the teaching of golf according to the invention comprises essentially a pedestal 1, a retractable strike head 2 and means of indicating the strike angle 4 including a disc 8 rotatably mounted on said pedestal 1 and on the rotational axis of which the retractable head 2 is fixed.

The retractable head has a face 3 essentially reversed with respect to the face of the head of a club in a way that essentially conforms to the face of the club in the event of correct impact of a club against said retractable head.

Under the effect of the impact transmitted by such a club during a swing, this head is capable of being folded back in such a way as to be accommodated in an opening 11 in the disc 8 specially provided for this purpose and designed in such a way that when the head 8 is folded back into the opening 1, this head does not jut out from the disc 8 in order not to hinder the progress of the swing after the impact. Under the effect of the impact, the head 8 is generally able to communicate a movement of the disc in relation to the pedestal 1, if the angle of strike between the face 3 of the retractable head and the face of the club head is not approximately equal to 0, that is to say if the angle of strike and hence the swing are not correct in order to correspond, in reality, to an acceptable trajectory of the ball.

In order to make a material representation of the extent of the fault made, means 12 of displaying the movement of disc 8 following the impact are provided on this disc and on the pedestal 1. Within the context of this embodiment, these display means 12 are constituted by an arrow 12*a* co-operating with a coloured graduated scale 12*b* provided on the pedestal 1 at the periphery of the disc 8. It will be understood however, that these means of display may be constituted by any other suitable means.

According to the nature of the strike angle, the disc 8 rotates in one or the other possible directions of rotation symbolised by the double arrow 13. According to the size of this angle, the arrow 12 indicates one of the coloured graduations 12*b*. It is therefore possible for the player to evaluate the size of the fault made and hence to work on his swing in order to arrive at a folding back of the retractable head 2 that does not cause the disc to turn, that would mean that the face of the club is attacking the retractable head in correct fashion, in order to correspond to a good trajectory of the ball in reality.

Figure 2:
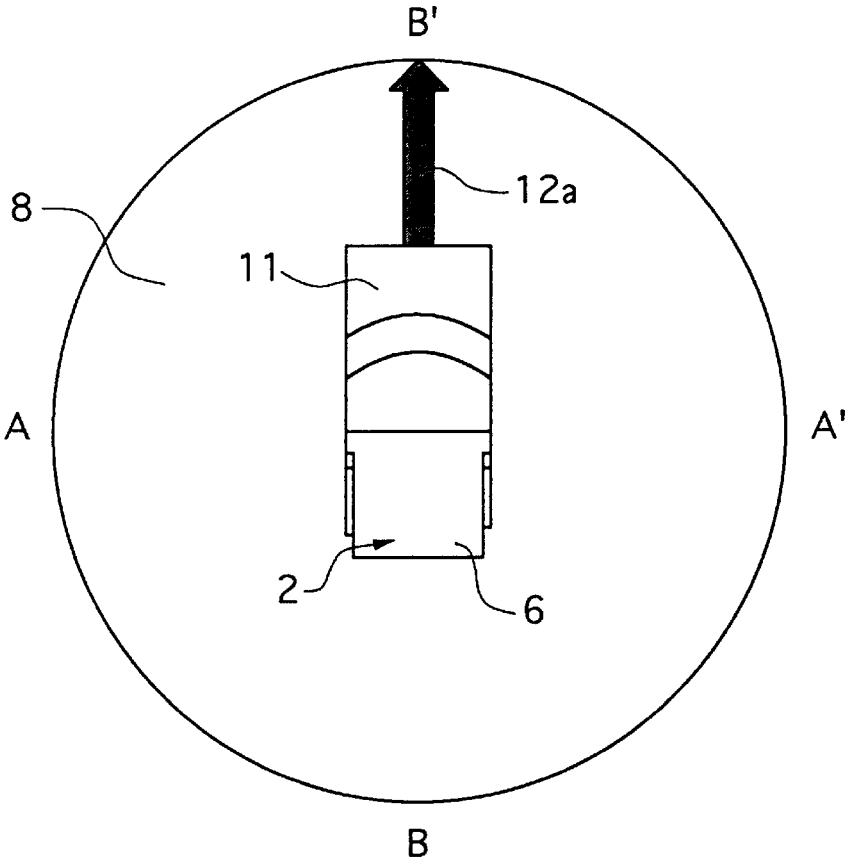
FIG. 2 represents a view from above of the central part of the device according to FIG. 1.

As can be seen in FIG. 2, the retractable head is made up of an element 6 rigidly mounted onto disc 8.

Figure 3:
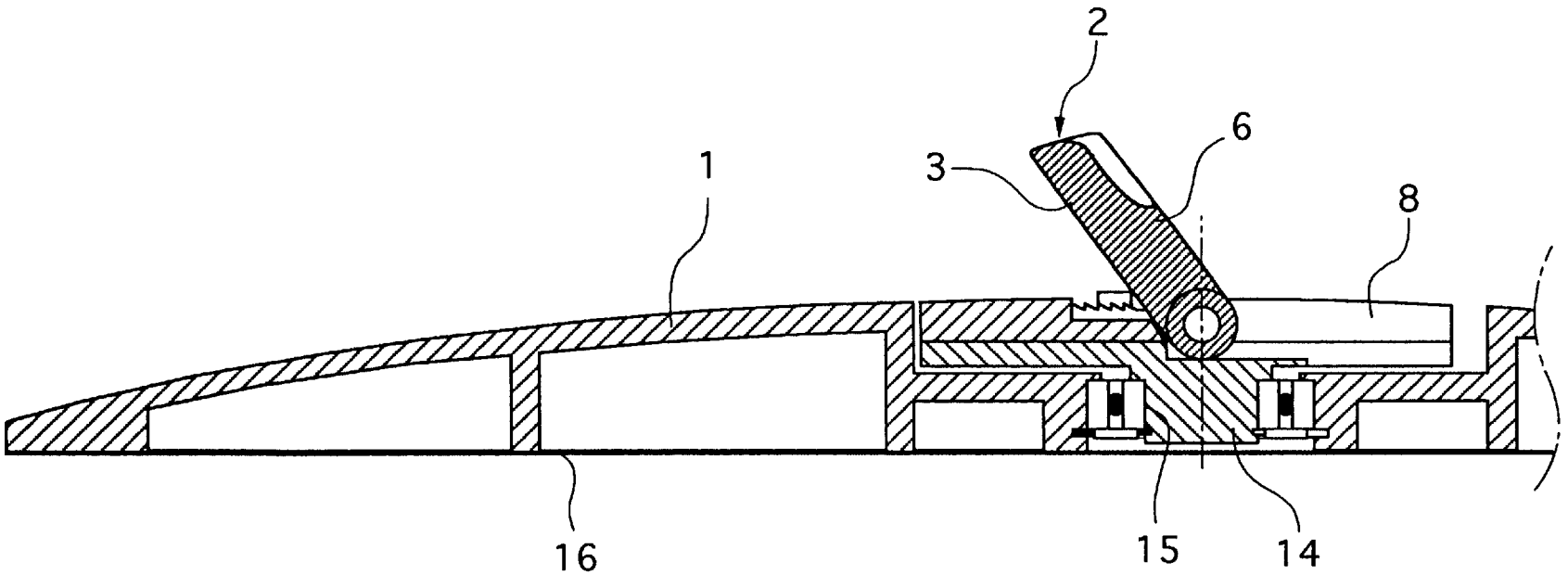
FIG. 3 represents half section view of the device shown in FIG. 1.

Referring to FIG. 3, so as to permit movement of the disc 3, it is fixed onto a bearing 14 rotatably mounted on the pedestal 1 using a ball bearing 15, as may be seen in FIG. 3. The assembly is supported on a baseplate 16.

Figure 4:
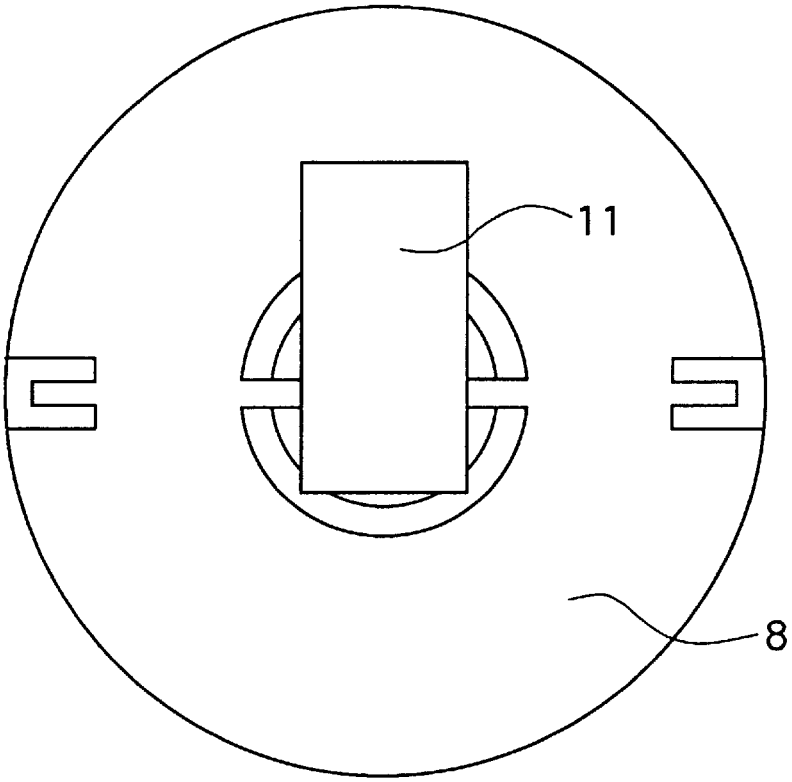
FIG. 4 represents a view from below of the rotatable disc of the device.
Figure 5:
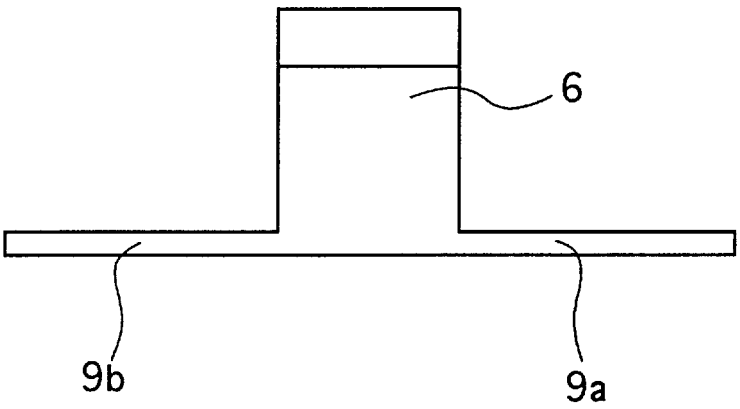
FIG. 5 represents a front elevation view of the retractable head.

Referring to FIGS. 4 and 5, the first element 6 has arms 9*a,* 9*b* extending along the diameter of the disc 8 and allowing the transmission of forces produced by the club at the time of impact to the periphery of the disc, allowing the rotation of the disc as soon as these forces are not perpendicular to the reversed face 3 of the retractable head 2. Furthermore, the upper part of the element 6 is slotted in a way that facilitates setting this element upright when the head is retracted. It should be noted of course that other means of setting this component upright could be envisaged without departing from the scope of the invention.

Figure 6:
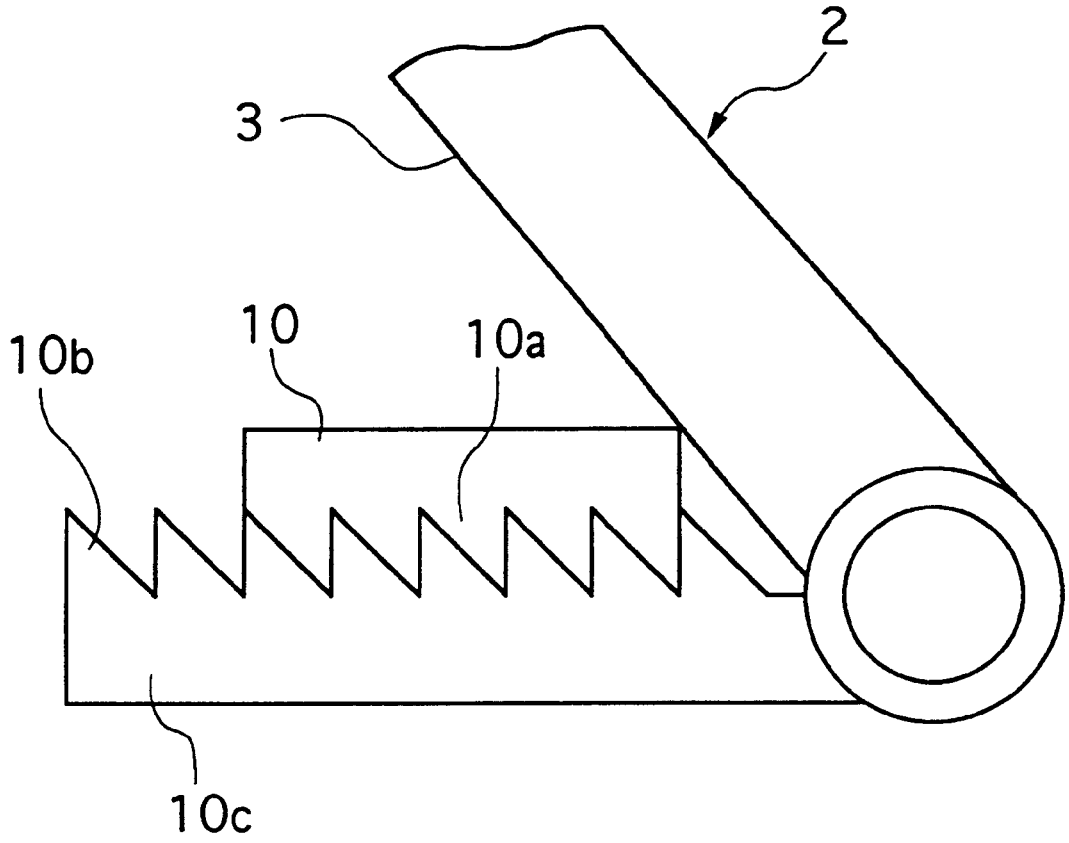
FIG. 6 represents a cross section view of the means of adjusting the inclination of the retractable head.

So as to adjust the inclination of the head 2 and thereby to allow the matching of the device to different clubs, means of adjusting this inclination are provided. Such means are represented in FIG. 6. Within the context of this embodiment, these means of adjustment are constituted by a detachable pin 10 having teeth 10*a* provided to co-operate with notches 10*b* in a component 10*c*. According to the position of the head 2 that is sought, it is possible to choose the position of the removable pin on the component 10*c*.

During use of the device described, the player, after having chosen his club, positions the retractable head 2 at the angle corresponding to the club in question.

Once the retractable head 2 is inclined at the angle corresponding to the club being used, the player can take up position in relation to the retractable head in the same way that he would position himself in reality to a golf ball, and he can work on the impact that he communicates to the head with his club.

The nature of the strike angle is given by the rotation of the disc 8. If such rotation does not occur, the strike angle is considered to be correct. If the disc 8 rotates following the impact, the strike angle is incorrect. Depending on the area of colour 12*b* indicated by the arrow 12*a,* the extent of the fault can be easily and rapidly assessed by the player.

Figure 7:
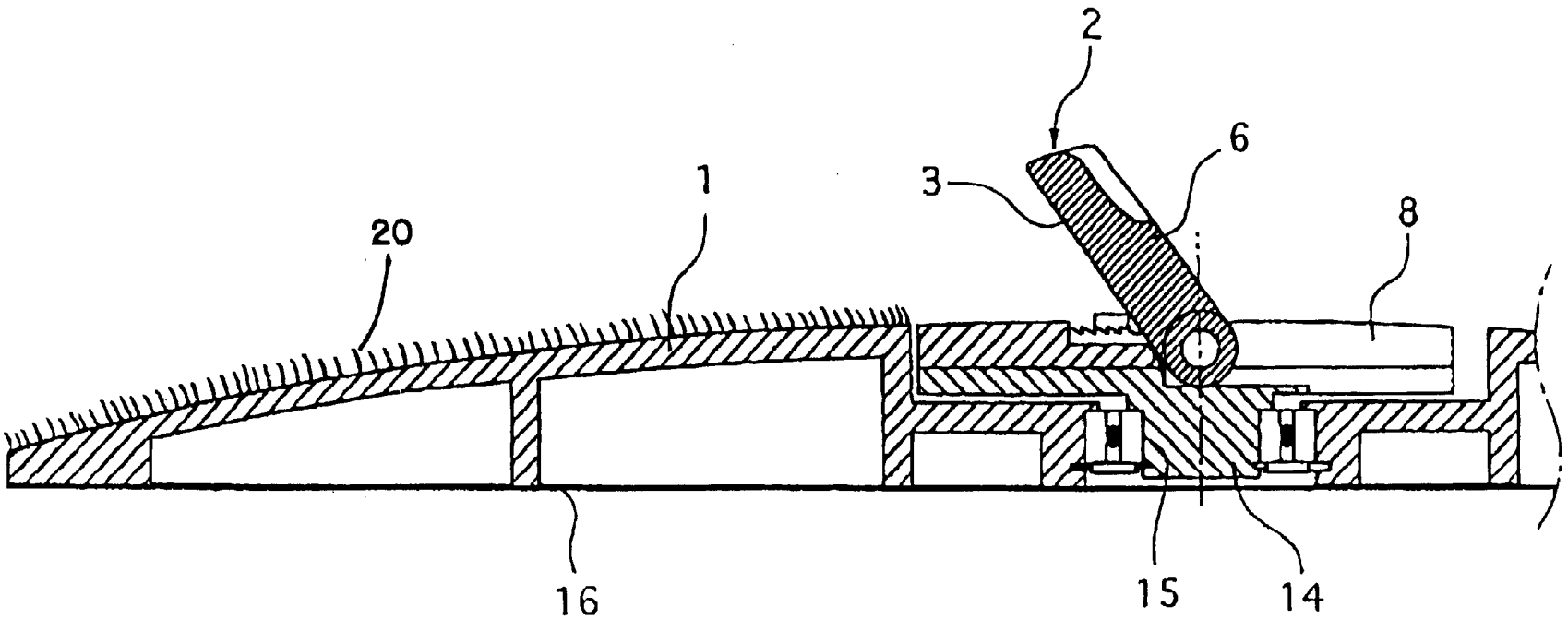
FIG. 7 represents a half section view of a device, the pedestal of which is covered by a synthetic turf.

FIG. 7 shows another element of the present invention which differs only by the feature according to which a covering 20 is provided on the pedestal 1. The covering 20 is a synthetic turf which will produce a noise when it is touched by the golf club head during the swing.

I claim:

1. A device for the teaching of golf, designated to rest on a surface and having portions to be struck by a golf club, comprising: a substantially flat pedestal (1), a strike head (2) mounted on said pedestal to be struck by said golf club (1), said strike head having a face that substantially conforms to the face of said golf club and means for indicating the strike angle (4) of said golf club on said strike head (2) that includes a disc (8) integral with said strike head (2) and rotatably mounted on said pedestal (1) substantially in the plane of the pedestal, said strike head (2) being positioned on said disc, and means for the display (12) of the displacement of said disc (8) in relation to said pedestal (1) following the impact of said golf club on said strike head (2).

2. A device according to claim 1 characterised in that said strike head (2) is preferably movably mounted on said pedestal (1) and is able to retract under the impact transmitted by said golf club in a way that does not hinder the trajectory of it.

3. A device according to claim 1 characterised in that said pedestal is covered at least in part by a covering having surface irregularities.

4. A device according to claim 1 characterised in that it includes means that allow attenuation of the rotation of said disc (8).

5. A device according to claim 1 characterised in that said display means include a graduated scale on said disc and/or said pedestal (1).

6. A device according to claim 5 characterised in that said graduated scale is coloured.

7. A device according to claim 1 characterised in that said first element (6) includes two arms (9*a,* 9*b*) for fixing it onto said disc, said arms extending essentially over the whole diameter of said disc (8).

8. A device according to claim 1 characterised in that said strike head (2) is removable and interchangeable.

9. A device according to claim 1 characterised in that it includes means of adjusting the inclination of said strike head (2).

10. A device according to claim 9 characterised in that the means of adjusting the inclination of said head include a detachable pin (10).

11. A device according to claim 1, characterized in that said strike head is positioned approximately at a center of said disc.

12. A device according to claim 1, characterized in that said strike head is made of an elastic material.

13. A device according to claim 1, characterized in that the device further includes means for attenuating location of the disc.

* * * * *

UNITED STATES PATENT AND TRADEMARK OFFICE

CERTIFICATE OF CORRECTION

PATENT NO. : 6,106,406
DATED : August 22, 2000
INVENTOR(S) : Jouan

It is certified that error appears in the above-identified patent and that said Letters Patent is hereby corrected as shown below:

Column 1,
Line 40, "700" should read -- 70° --

Signed and Sealed this

Nineteenth Day of March, 2002

*Attest:*

*Attesting Officer*

JAMES E. ROGAN
*Director of the United States Patent and Trademark Office*